US007770629B2

(12) United States Patent
Weicker et al.

(10) Patent No.: US 7,770,629 B2
(45) Date of Patent: Aug. 10, 2010

(54) MOULDING MIXTURE FOR PRODUCING CASTING MOULDS FOR METALWORKING

(75) Inventors: Günter Weicker, Solingen (DE); Diether Koch, Mettmann (DE); Jens Müller, Haan (DE); Udo Skerdi, Bendorf/Rhein (DE); Henning Rehse, Wermelskirchen (DE); Anton Gienic, Hilden (DE); Reinhard Stötzel, Borken (DE); Thomas Dünnwald, Köln (DE)

(73) Assignee: AS Lungen GmbH, Bendorf/Rhein (DE)

( * ) Notice: Subject to any disclaimer, the term of this patent is extended or adjusted under 35 U.S.C. 154(b) by 372 days.

(21) Appl. No.: 11/574,526

(22) PCT Filed: Sep. 2, 2005

(86) PCT No.: PCT/EP2005/009470

§ 371 (c)(1),
(2), (4) Date: Aug. 13, 2007

(87) PCT Pub. No.: WO2006/024540

PCT Pub. Date: Mar. 9, 2006

(65) Prior Publication Data

US 2008/0099180 A1 May 1, 2008

(30) Foreign Application Priority Data

Sep. 2, 2004 (DE) ..... 10 2004 042 535

(51) Int. Cl.
*B22C 1/00* (2006.01)

(52) U.S. Cl. ..... 164/528; 164/520

(58) Field of Classification Search ..... 164/520–529
See application file for complete search history.

(56) References Cited

U.S. PATENT DOCUMENTS 3,409,579 A 11/1968 Robins
4,162,238 A 7/1979 Bergna
4,638,845 A * 1/1987 Sato et al. ..... 164/12
5,333,673 A * 8/1994 Hughes ..... 164/528

(Continued)

FOREIGN PATENT DOCUMENTS

EP 1122002 A1 8/2001

(Continued)

OTHER PUBLICATIONS

English translation of Interntional Preliminary Report on Patentability pertaining to international application No. PCT/ EP2006/008571, filed in the U.S. Appl. No. 12/065,522. This application may contain information material to the patentability of the current application.

(Continued)

*Primary Examiner*—Kuang Lin
(74) *Attorney, Agent, or Firm*—Scott R. Cox

(57) ABSTRACT

The invention relates to a moulding mixture for producing casting moulds for metalworking, a process for producing casting moulds, casting moulds obtained by the process and also their use. To produce the casting moulds, a refractory mould raw material and a binder based on water glass are used. A proportion of a particulate metal oxide selected from the group consisting of silicon dioxide, aluminium oxide, titanium oxide and zinc oxide is added to the binder. Particular preference is given to using synthetic amorphous silicon dioxide as metal oxide.

23 Claims, 2 Drawing Sheets

U.S. PATENT DOCUMENTS

| | | | | |
|---|---|---|---|---|
| 5,417,751 | A | 5/1995 | Twardowska et al. | |
| 5,474,606 | A | 12/1995 | Twardowska | |
| 5,582,232 | A | 12/1996 | Bambauer | |
| 5,837,047 | A | 11/1998 | Twardowska et al. | |
| 6,232,368 | B1 * | 5/2001 | White | 523/145 |
| 6,372,032 | B1 | 4/2002 | Miki | |
| 6,972,059 | B1 | 12/2005 | Skerdi | |
| 7,022,178 | B1 | 4/2006 | Steinhauser | |
| 2001/0022999 | A1 * | 9/2001 | Twardowska et al. | 428/34.6 |
| 2003/0183364 | A1 | 10/2003 | El-Demallawy et al. | |

FOREIGN PATENT DOCUMENTS

| | | | |
|---|---|---|---|
| GB | 782205 | | 9/1957 |
| JP | 51035621 | | 3/1976 |
| JP | 51049121 | | 4/1976 |
| JP | 52-124414 | * | 10/1977 |
| JP | 52138434 | | 11/1977 |
| JP | 52146720 | | 12/1977 |
| JP | 06063683 | | 8/1994 |
| JP | 07303935 | | 11/1995 |
| WO | WO9414555 | | 7/1994 |
| WO | WO9806522 | | 2/1998 |
| WO | WO0071281 | | 11/2000 |

OTHER PUBLICATIONS

Office Action dated Oct. 6, 2008 with respect to U.S. Appl. No. 10/537,530.

Lemon, P., "Modern sand binders -a review", Foundry Trade Journal 163 (1989), pp. 922-924, 926.

Amendment filed Jan. 30, 2009 in response to Office Action dated Oct. 6, 2008 with respect to U.S. Appl. No. 10/537,530.

* cited by examiner

MOULDING MIXTURE FOR PRODUCING CASTING MOULDS FOR METALWORKING

The invention relates to a moulding mixture for producing casting moulds for metalworking, which comprises at least one refractory mould raw material which is capable of powder flow and a binder based on water glass. The invention further relates to a process for producing casting moulds for metalworking using the moulding mixture and also a casting mould obtained by the process.

Casting moulds for producing metal bodies are produced essentially in two forms. A first group is formed by cores or moulds. The casting mould which is essentially the negative of the casting to be produced is assembled from these. A second group is formed by hollow bodies, known as feeders, which act as equilibration reservoirs. These take up liquid metal, with appropriate measures ensuring that the metal remains in the liquid phase for longer than the metal which is present in the casting mould forming the negative mould. When the metal solidifies in the negative mould, further liquid metal can flow from the equilibration reservoir in order to compensate for the volume contraction occurring on solidification of the metal.

Casting moulds comprise a refractory material, for example silica sand, whose grains are bound together by means of a suitable binder after demoulding of the casting mould in order to ensure sufficient mechanical strength of the casting mould. Thus, a refractory mould raw material which has been treated with a suitable binder is used for producing casting moulds. The refractory mould raw material is preferably in a form which is capable of powder flow, so that it can be introduced into a suitable hollow mould and consolidated there. The binder produces firm cohesion between the particles of the mould raw material, so that the casting mould is given the required mechanical stability.

Casting moulds have to meet various requirements. In the casting process itself, they firstly have to have sufficient stability and heat resistance to accommodate the liquid metal in the hollow space formed by one or more (parts of) casting moulds. After commencement of solidification, the mechanical stability of the casting mould is ensured by a solidified metal layer which forms along the walls of the hollow space. The material of the casting mould then has to decompose under the action of the heat given off by the metal so that it loses its mechanical strength, i.e. cohesion between individual particles of the refractory material is lost. This is achieved, for example, by the binder decomposing under the action of heat. After cooling, the solidified casting is shaken, and in the ideal case the material of the casting moulds disintegrates again to leave a fine sand which can be poured from the hollow spaces of the shaped metal body.

To produce casting moulds, it is possible to use either organic or inorganic binders which can in each case be cured by cold or hot processes. The term cold processes is used to refer to processes which are carried out essentially at room temperature without heating of the casting mould. In this case, curing usually occurs by means of a chemical reaction which is, for example, triggered by a gas being passed as catalyst through the mould to be cured. In hot processes, the moulding mixture is, after shaping, heated to a temperature which is sufficiently high for, for example, the solvent present in the binder to be driven off or to initiate a chemical reaction by means of which the binder is cured, for example by crosslinking.

At present, organic binders in the case of which the curing reaction is accelerated by a gaseous catalyst or the reaction is initiated by a gaseous hardener are frequently used for producing casting moulds. These processes are referred to as "cold box" processes.

An example of the production of casting moulds using organic binders is the Ashland cold box process. In this, a two-component system is used. The first component comprises the solution of a polyol, usually a phenolic resin. The second component is the solution of a polyisocyanate. Thus, according to U.S. Pat. No. 3,409,579 A, the two components of the polyurethane binder are caused to react by passing a gaseous tertiary amine through the mixture of mould raw material and binder after shaping. The curing reaction of polyurethane binders is a polyaddition, i.e. a reaction without elimination of by-products such as water. The further advantages of this cold box process include good productivity, dimensional accuracy of the casting moulds and good technical properties such as strength of the casting moulds, processing time of the mixture of mould raw material and binder, etc.

Hot-curing organic processes include the hot box process based on phenolic or furan resins, the warm box process based on furan resins and the Croning process based on phenolic novolak resins. Both in the hot box process and in the warm box process, liquid resins are processed together with a latent hardener which acts only at elevated temperature to give a moulding mixture. In the Croning process, mould raw materials such as silica sands, chromium ore sands, zircon sands, etc., are surrounded at a temperature of from about 100 to 160° C. with a phenol novolak resin which is liquid at this temperature. Hexamethylenetetramine is added as reaction partner for future curing. In the abovementioned hot-curing technologies, shaping and curing take place in heatable tools which are heated to a temperature of up to 300° C. Regardless of the curing mechanism, all organic systems can decompose thermally when the liquid metal is introduced into the casting mould and in the process give off harmful substances such as benzene, toluene, xylenes, phenol, formaldehyde and higher cracking products, some of which have not been identified. Although various measures have allowed these emissions to be minimized, they cannot be completely avoided when using organic binders. In the case of inorganic-organic hybrid systems which, as in the case of, for example, the binders used in the resol-$CO_2$ process, contain a proportion of organic compounds, such undesirable emissions also occur during casting of the metals.

To avoid the emission of decomposition products during the casting process, it is necessary to use binders which are based on inorganic materials or contain at most a very small proportion of organic compounds. Such binder systems have been known for a relatively long time. Binder systems which can be cured by introduction of gases have been developed. Such a system is described, for example, in GB 782 205 in which an alkali metal water glass which can be cured by introduction of $CO_2$ is used as binder. DE 199 25 167 describes an exothermic feeder composition which contains an alkali metal silicate as binder. Furthermore, binder systems which are self-curing at room temperature have been developed. Such a system based on phosphoric acid and metal oxides is described, for example, in U.S. Pat. No. 5,582,232. Finally, inorganic binder systems which are cured at relatively high temperatures, for example in a hot tool, are also known. Such hot-curing binder systems are, for example, known from U.S. Pat. No. 5,474,606 in which a binder system comprising alkali metal water glass and aluminium silicate is described.

Compared to organic binders, inorganic binders have the disadvantage that the casting moulds produced therefrom have relatively low strengths. This becomes particularly clearly apparent immediately after taking off the casting mould from the tool. However, good strengths at this point in time are particularly important for the production of complicated, thin-walled shaped bodies and handling them safely. The reasons for the low strengths is first and foremost that the casting moulds still contain residual water from the binder. Longer residence times in the hot closed tool help to only a limited extent, since the water vapour cannot escape to a sufficient extent. To achieve very complete drying of the casting moulds, WO 98/06522 proposes leaving the moulding mixture after demoulding in a heated core box only until a dimensionally stable and load-bearing shell around the outside is formed. After opening of the core box, the mould is taken out and subsequently dried completely under the action of microwaves. However, the additional drying is complicated, increases the production time of the casting moulds and contributes considerably, not least because of the energy costs, to making the production process more expensive.

A further weak point of the inorganic binders known hitherto is that the casting moulds produced therewith have a low stability toward high atmospheric moisture. Storage of the shaped bodies for a relatively long period of time, as is customary in the case of organic binders, is therefore not reliably possible.

EP 1 122 002 describes a process which is suitable for producing casting moulds for metal casting. To produce the binder, an alkali metal hydroxide, in particular sodium hydroxide, is mixed with a particulate metal oxide which can form a metalate in the presence of the alkali metal hydroxide. The particles are dried after a layer of the metalate has been formed on the outside of the particles. In the core of the particles, there remains a section in which the metal oxide has not been reacted. As metal oxide, preference is given to using a finely divided silicon dioxide or finely divided titanium oxide or zinc oxide.

WO 94/14555 describes a moulding mixture which is suitable for producing casting moulds and contains a refractory mould raw material together with a binder comprising a phosphate glass or borate glass, with the mixture additionally containing a finely divided refractory material. As refractory material, it is also possible to use, for example, silicon dioxide.

EP 1 095 719 A2 describes a binder system for mould sands for producing cores. The binder system based on water glass comprises an aqueous alkali metal silicate solution and a hygroscopic base, for example sodium hydroxide, which is added in a ratio of from 1:4 to 1:6. The water glass has an $SiO_2/M_2O$ ratio of from 2.5 to 3.5 and a solids content of from 20 to 40%. To obtain a moulding mixture which is capable of powder flow and can also be introduced into complicated core moulds and also to control the hygroscopic properties, the binder system contains a surface-active substance such as silicone oil having a boiling point of ≧250° C. The binder system is mixed with a suitable refractory solid such as silica sand and can then be shot into a core box by means of a core shooting machine. Curing of the moulding mixture occurs by withdrawal of the water still present. The drying or curing of the casting mould can also be effected by means of microwaves.

The moulding mixtures known hitherto for producing casting moulds still have room for improvement of the properties, for example in respect of the strength of the casting moulds produced and in respect of their resistance to atmospheric moisture when stored for a relatively long period of time. Furthermore, it is desirable for a high quality of the surface of the casting to be achieved directly after casting, so that the after-working of the surface can be carried out with little effort.

It was therefore an object of the invention to provide a moulding mixture for producing casting moulds for metalworking, which comprises at least one refractory mould raw material and a binder system which is based on water glass and makes it possible to produce casting moulds which have a high strength both immediately after shaping and during prolonged storage.

Furthermore, the moulding mixture should make it possible to produce casting moulds by means of which castings having a high quality of the surface can be produced, so that only a small amount of after-working of the surfaces is necessary.

This object is achieved by a moulding mixture having the features of claim 1. Advantageous embodiments of the moulding mixture of the invention are the subject matter of the dependent claims.

It has surprisingly been found that the use of a binder containing both an alkali metal water glass and a particulate metal oxide selected from the group consisting of silicon dioxide, aluminium oxide, titanium oxide and zinc oxide enables the strength of casting moulds to be improved significantly both immediately after shaping and curing and also during storage under elevated atmospheric humidity. The abovementioned particulate metal oxides can be used either individually or in combination.

The moulding mixture of the invention for producing casting moulds for metalworking comprises at least:

a refractory mould raw material; and a binder based on water glass.

As refractory mould raw material, it is possible to use materials customary for producing casting moulds. Suitable materials are, for example, silica sand or zircon sand. Furthermore, fibrous refractory mould raw materials such as chamotte fibres are also suitable. Further suitable refractory mould raw materials are, for example, olivine, chromium ore sand, vermiculite.

Further materials which can be used as refractory mould raw materials are synthetic moulding materials such as hollow aluminium silicate spheres (known as microspheres), glass beads, glass granules or spherical ceramic mould raw materials known under the trade name "Cerabeads" or "Carboaccucast". These spherical ceramic mould raw materials contain, for example, mullite, α-alumina, β-cristobalite in various proportions as minerals. They contain aluminium oxide and silicon dioxide as significant components. Typical compositions contain, for example, $Al_2O_3$ and $SiO_2$ in approximately equal proportions. In addition, further constituents can also be present in proportions of <10%, e.g. $TiO_2$, $Fe_2O_3$. The diameter of the microspheres is preferably less than 1000 μm, in particular less than 600 μm. Synthetically produced refractory mould raw materials such as mullite ($x\,Al_2O_3 \cdot y\,SiO_2$, where x=2 to 3, y=1 to 2; ideal formula: $Al_2SiO_5$) are also suitable. These synthetic mould raw materials are not derived from a natural source and can also have been subjected to a particular shaping process, as, for example, in the case of the production of hollow aluminium silicate microspheres, glass beads or spherical ceramic mould raw materials.

Particular preference is given to using glass materials as refractory synthetic mould raw materials. These are, in particular, used either as glass spheres or as glass granules. As glass, it is possible to use conventional glasses, preferably glasses which have a high melting point. It is possible to use, for example, glass beads and/or glass granules produced from crushed glass. Borate glasses are likewise suitable. The composition of such glasses is indicated by way of example in the following table.

TABLE

| Constituent | Composition of glasses: Crushed glass | Borate glass |
|---|---|---|
| $SiO_2$ | 50-80% | 50-80% |
| $Al_2O_3$ | 0-15% | 0-15% |
| $Fe_2O_3$ | <2% | <2% |
| $M^{II}O$ | 0-25% | 0-25% |
| $M^{I}_2O$ | 5-25% | 1-10% |
| $B_2O_3$ | | <15% |
| Others | <10% | <10% |

$M^{II}$: Alkaline earth metal, e.g. Mg, Ca, Ba
$M^{I}$: Alkali metal, e.g. Na, K However, apart from the glasses given in the table, it is also possible to use other glasses whose contents of the above-mentioned compounds are outside the ranges given. Likewise, it is also possible to use speciality glasses which contain other elements or oxides thereof in addition to the oxides mentioned.

The diameter of the glass spheres is preferably less than 1000 μm, in particular less than 600 μm.

In casting experiments using aluminium, it has been found that when synthetic mould raw materials, especially glass beads, glass granules or microspheres, are used, less mould sand remains adhering to the metal surface after casting than when pure silica sand is used. The use of synthetic mould raw materials therefore makes it possible to produce smoother cast surfaces, so that complicated after-working by blasting is necessary to a significantly reduced extent, if at all.

It is not necessary for the entire mould raw material to be made up of the synthetic mould raw materials. The preferred proportion of synthetic mould raw materials is at least about 3% by weight, particularly preferably at least 5% by weight, in particular at least 10% by weight, preferably at least about 15% by weight, particularly preferably at least about 20% by weight, based on the total amount of the refractory mould raw material.

The refractory mould raw material is preferably capable of powder flow so that the moulding mixture of the invention can be processed in conventional core shooting machines.

As further component, the moulding mixture of the invention comprises a binder based on water glass. As water glass, it is possible to use conventional water glasses as have hitherto been used as binders in moulding mixtures. These water glasses comprise dissolved sodium or potassium silicates and can be prepared by dissolving vitreous potassium and sodium silicates in water. The water glass preferably has an $SiO_2/M_2O$ ratio in the range from 1.6 to 4.0, in particular from 2.0 to 3.5, where M is sodium and/or potassium. The water glasses preferably have a solids content in the range from 30 to 60% by weight. The solids content is based on the amount of $SiO_2$ and $M_2O$ present in the water glass.

According to the invention, the moulding mixture contains a proportion of a particulate metal oxide selected from the group consisting of silicon dioxide, aluminium oxide, titanium dioxide and zinc oxide. The particle size of these metal oxides is preferably less than 300 μm, preferably less than 200 μm, particularly preferably less than 100 μm. The particle size can be determined by sieve analysis. The sieve residue left on a sieve having a mesh opening of 63 μm is particularly preferably less than 10% by weight, more preferably less than 8% by weight.

As particulate metal oxide, particular preference is given to using silicon dioxide, particularly preferably synthetic amorphous silicon dioxide.

As particulate silicon dioxide, preference is given to using precipitated silica and/or pyrogenic silica. Precipitated silica is obtained by reaction of an aqueous alkali metal silicate solution with mineral acids. The precipitate obtained is subsequently separated off, dried and milled. For the purposes of the present invention, pyrogenic silicas are silicas which are obtained by coagulation from the gas phase at high temperatures. Pyrogenic silica can be produced, for example, by flame hydrolysis of silicon tetrachloride or in an electric arc furnace by reduction of silica sand by means of coke or anthracite to form silicon monoxide gas followed by oxidation to silicon dioxide. The pyrogenic silicas produced by the electric arc furnace process can still contain carbon. Precipitated silica and pyrogenic silica are equally suitable for the moulding mixture of the invention. These silicas will hereinafter be referred to as "synthetic amorphous silicon dioxide".

The inventors assume that the strongly alkaline water glass can react with the silanol groups present on the surface of the synthetic amorphous silicon dioxide and that evaporation of the water results in formation of a strong bond between the silicon dioxide and the then solid water glass.

The moulding mixture of the invention is an intimate mixture of at least the constituents mentioned. Here, the particles of the refractory mould raw material are preferably coated with a layer of the binder. Firm cohesion between the particles of the refractory mould raw material can then be achieved by evaporation of the water present in the binder (about 40-70% by weight, based on the weight of the binder).

The binder, i.e. the water glass and the particulate metal oxide, in particular synthetic amorphous silicon dioxide, is preferably present in a proportion of less than 20% by weight in the moulding mixture. If massive mould raw materials, for example silica sand, are used, the binder is preferably present in a proportion of less than 10% by weight, preferably less than 8% by weight, particularly preferably less than 5% by weight. If refractory mould raw materials which have a low density, for example the above-described hollow microspheres, are used, the proportion of binder increases correspondingly.

The particulate metal oxide, in particular the synthetic amorphous silicon dioxide, is, based on the weight of the binder, preferably present in a proportion of from 2 to 60% by weight, more preferably from 3 to 50% by weight, particularly preferably from 4 to 40% by weight.

The ratio of water glass to particulate metal oxide, in particular synthetic amorphous silicon dioxide, can be varied within a wide range. This offers the advantage that the initial strength of the casting mould, i.e. the strength immediately after removal from the hot tool, and the moisture resistance can be improved without the final strengths, i.e. the strengths after cooling of the casting mould, compared to a water glass binder without amorphous silicon dioxide being significantly affected. This is of especially great interest in light metal casting. On the one hand, high initial strengths are desirable in order to allow the casting mould produced to be transported without problems or be assembled with other casting moulds, but on the other hand the final strength after curing should not be too high in order to avoid difficulties with binder decomposition after casting, i.e. the mould material should be able to be removed without problems from hollow spaces of the cast body after casting.

The mould raw material present in the moulding mixture of the invention can, in one embodiment of the invention, contain at least a proportion of hollow microspheres. The diameter of the hollow microspheres is normally in the range from 5 to 500 μm, preferably in the range from 10 to 350 μm, and the thickness of the shell is usually in the range from 5 to 15% of the diameter of the microspheres. These microspheres have a very low specific gravity, so that the casting moulds produced using hollow microspheres have a low weight. The insulating action of the hollow microspheres is particularly advantageous. The hollow microspheres are therefore used for the production of casting moulds particularly when these are to have an increased insulating action. Such casting moulds are, for example, the feeders described at the outset, which act as equilibration reservoir and contain liquid metal, with the intention being that the metal is maintained in a liquid state until the metal introduced into the hollow mould has solidified. Another field of application for casting moulds containing hollow microspheres is, for example, sections of a casting mould which correspond to particularly thin-walled sections of the finished casting. The insulating action of the hollow microspheres ensures that the metal does not solidify prematurely in the thin-walled sections and thus blocks the paths within the casting mould.

If hollow microspheres are used, the binder is, due to the low density of these hollow microspheres, preferably used in a proportion of preferably less than 20% by weight, particularly preferably in a proportion of from 10 to 18% by weight.

The hollow microspheres preferably comprise an aluminium silicate. These hollow aluminium silicate microspheres preferably have an aluminium oxide content of more than 20% by weight, but can also have a content of more than 40% by weight. Such hollow microspheres are marketed, for example, by Omega Minerals Germany GmbH, Norderstedt, under the trade names omega-Spheres® SG having an aluminium oxide content of about 28-33%, Omega-Spheres® WSG having an aluminium oxide content of about 35-39% and E-Spheres® having an aluminium oxide content of about 43%. Corresponding products are obtainable from PQ Corporation (USA) under the trade name "Extendospheres®".

In a further embodiment, hollow microspheres made up of glass are used as refractory mould raw material.

In a particularly preferred embodiment, the hollow microspheres comprise a borosilicate glass. The borosilicate glass has a proportion of boron, calculated as $B_2O_3$ of more than 3% by weight. The proportion of hollow microspheres is preferably less than 20% by weight, based on the moulding mixture. When hollow borosilicate glass microspheres are used, a low proportion is preferably chosen. This is preferably less than 5% by weight, more preferably less than 3% by weight and particularly preferably in the range from 0.01 to 2% by weight.

As mentioned above, the moulding mixture of the invention contains, in a preferred embodiment, at least a proportion of glass granules and/or glass beads as refractory mould raw material.

It is also possible to produce the moulding mixture as an exothermic moulding mixture which is, for example, suitable for producing exothermic feeders. For this purpose, the moulding mixture contains an oxidizable metal and a suitable oxidant. Based on the total mass of the moulding mixture, the oxidizable metals are preferably present in a proportion of from 15 to 35% by weight. The oxidant is preferably added in a proportion of from 20 to 30% by weight, based on the moulding mixture. Suitable oxidizable metals are, for example, aluminium and magnesium. Suitable oxidants are, for example, iron oxide and potassium nitrate.

Binders which contain water have a poorer flowability than binders based on organic solvents. This means that moulding tools having narrow passages and a number of bends can be filled less readily. As a consequence, the casting moulds have sections with unsatisfactory consolidation, which in turn can lead to casting defects in casting. In an advantageous embodiment, the moulding mixture of the invention contains a proportion of platelet-like lubricants, in particular graphite or $MOS_2$. It has surprisingly been found that when such lubricants, in particular graphite, are added, even complex shapes having thin-walled sections can be produced, with the casting moulds having a uniformly high density and strength throughout, so that essentially no casting defects were observed in casting. The amount of platelet-like lubricant, in particular graphite, added is preferably from 0.1% by weight to 1% by weight, based on the mould raw material.

Apart from the abovementioned constituents, the moulding mixture of the invention can comprise further additives. For example, it is possible to add internal mould release agents which aid detachment of the casting moulds from the moulding tool. Suitable internal mould release agents are, for example, calcium stearate, fatty acid esters, waxes, natural resins or specific alkyd resins. Furthermore, silanes can also be added to the moulding mixture of the invention.

In a preferred embodiment, the moulding mixture of the invention therefore contains an organic additive which has a melting point in the range from 40 to 180° C., preferably from 50 to 175° C., i.e. is solid at room temperature. For the present purposes/organic additives are compounds whose molecular skeleton is made up predominantly of carbon atoms, i.e., for example, organic polymers. The addition of the organic additives enables the quality of the surface of the casting to be improved further. The mode of action of the organic additives has not been elucidated. However, without wishing to be tied to this theory, the inventors assume that at least part of the organic additives burns during the casting process and a thin gas cushion between the liquid metal and the solid forming the wall of the casting mould is produced, thus preventing a reaction between the liquid metal and the mould material. Furthermore, the inventors assume that part of the organic additives forms a thin layer of glossy carbon under the reducing atmosphere prevailing during casting and this likewise prevents a reaction between metal and mould material. A further advantageous effect which can be achieved by addition of the organic additives is an increase in the strength of the casting mould after curing.

The organic additives are preferably added in an amount of from 0.01 to 1.5% by weight, in particular from 0.05 to 1.3% by weight, particularly preferably from 0.1 to 1.0% by weight, in each case based on the mould material.

It has surprisingly been found that an improvement in the surface of the casting can be achieved by means of very different organic additives. Suitable organic additives are, for example, phenol-formaldehyde resins such as novolaks, epoxy resins such as bisphenol A epoxy resins, bisphenol F epoxy resins or epoxidized novolaks, polyols such as polyethylene glycols or polypropylene glycols, polyolefins such as polyethylene or polypropylene, copolymers of olefins such as ethylene or propylene and further comonomers such as vinyl acetate, polyamides such as polyamide-6, polyamide-12 or polyamide-6,6, natural resins such as balsam resin, fatty acid esters such as cetyl palmitate, fatty acid amides such as ethylenediamine-bisstearamide and also metal soaps such as stearates or oleates of divalent or trivalent metals. The organic additives can be present either as pure substances or as a mixture of various organic compounds.

In a further preferred embodiment, the moulding mixture of the invention contains a proportion of at least one silane. Suitable silanes are, for example, aminosilanes, epoxysilanes, mercaptosilanes, hydroxy-silanes and ureidosilanes.

Examples of suitable silanes are γ-aminopropyltrimethoxysilane, γ-hydroxypropyltri-methoxysilane, 3-ureidopropyltriethoxysilane, γ-mercaptopropyltrimethoxysilane, γ-glycidoxypropyltri-methoxysilane,β-(3,4-epoxycyclohexyl) trimethoxysilane and N-β-(aminoethyl)-γ-aminopropyltrimethoxysilane.

Based on the particulate metal oxide, it is typically made of about 5-50% of silane, preferably about 7-45%, particularly preferably about 10-40%.

Despite the high strengths which can be achieved using the binder according to the invention, the casting moulds produced using the moulding mixture of the invention, in particular cores and moulds, display good disintegration after casting, in particular in the case of aluminium casting. However, the use of the shaped bodies produced from the moulding mixture of the invention is not restricted to light metal casting. The casting moulds are suitable in general for the casting of metals. Such metals are, for example, nonferrous metals such as brass or bronzes and also ferrous metals.

The invention further provides a process for producing casting moulds for metalworking, in which the moulding mixture of the invention is used. The process of the invention comprises the steps:

production of the above-described moulding mixture;

moulding of the moulding mixture;

curing of the moulding mixture by heating the moulding mixture to give the cured casting mould.

In the production of the moulding mixture of the invention, the refractory mould raw material is usually firstly placed in a mixing vessel and the binder is then added while stirring. The water glass and the particulate metal oxide, in particular the synthetic amorphous silicon dioxide, can in principle be added in any order. However, it is advantageous to add the liquid component first. The addition is carried out with vigorous stirring, so that the binder is distributed uniformly in the refractory mould raw material and coats the latter.

The moulding mixture is subsequently brought to the desired shape. Conventional methods are used for moulding. For example, the moulding mixture can be shot into the moulding tool with the aid of compressed air by means of a core shooting machine. The moulding mixture is subsequently cured by heating in order to vaporize the water present in the binder. Heating can, for example, be carried out in the moulding tool. It is possible to cure the casting mould completely in the moulding tool, but it is also possible to cure only the surface region of the casting mould so that it has sufficient strength to be able to be taken from the moulding tool. The casting mould can then be cured completely by withdrawing further water from it. This can be effected, for example, in an oven. The withdrawal of water can, for example, also be effected by evaporating the water under reduced pressure.

The moulding mixture is heated to a temperature in the range from 100° C. to 300° C. for curing. The curing of the casting moulds can be accelerated by blowing heated air into the moulding tool. In this embodiment of the process, rapid removal of the water present in the binder is achieved, as a result of which the casting mould is strengthened within periods of time suitable for industrial use. The temperature of the air blown in is preferably from 100° C. to 180° C., particularly preferably from 120° C. to 150° C. The flow rate of the heated air is preferably set so that curing of the casting mould occurs within periods of time suitable for industrial use. The periods of time depend on the size of the casting moulds produced. Curing in a time of less than 5 minutes, preferably less than 2 minutes, is sought. However, in the case of very large casting moulds, longer periods of time can also be necessary.

The removal of the water from the moulding mixture can also be effected by heating the moulding mixture by irradiation with microwaves. However, the irradiation with microwaves is preferably carried out after the casting mould has been taken from the moulding tool. However, the casting mould has to have achieved a sufficient strength to allow this. As mentioned above, this can be achieved, for example, by at least an outer shell of the casting mould being cured in the moulding tool.

As indicated above, the flowability of the moulding mixture of the invention can be improved by addition of platelet-like lubricants, in particular graphite and/or $MoS_2$. In production of the moulding mixture, the platelet-like lubricant, in particular graphite, can be added separately from the two binder components to the moulding mixture. However, it is equally possible to premix the platelet-like lubricant, in particular graphite, with the particulate metal oxide, in particular the synthetic amorphous silicon dioxide, and only then mix with the water glass and the refractory mould raw material.

If the moulding mixture comprises an organic additive, the addition of the organic additive can in principle be effected at any point in time during the production of the moulding mixture. The organic additive can be added as such or in the form of a solution.

Water-soluble organic additives can be used in the form of an aqueous solution. If the organic additives are soluble in the binder and are stable in this without decomposition for a number of months, they can also be dissolved in the binder and thus added together with this to the mould material. Water-insoluble additives can be used in the form of a dispersion or a paste. The dispersions or pastes preferably contain water as solvent. Solutions or pastes of the organic additives can in principle also be produced in organic solvents. However, if a solvent is used for the addition of the organic additives, preference is given to using water.

The organic additives are preferably added as powders or short fibres, with the mean particle size or the fibre length preferably being chosen so that it does not exceed the size of the mould material particles. The organic additives can particularly preferably pass through a sieve having a mesh opening of about 0.3 mm. To reduce the number of components added to the mould material, the particulate metal oxide and the organic additive or additives are preferably not added separately to the mould sand but are mixed beforehand.

If the moulding mixture contains silanes, the silanes are usually incorporated into the binder before being added. The silanes can also be added as separate component to the mould material. However, it is particularly advantageous to silanize the particulate metal oxide, i.e. mix the metal oxide with the silane, so that its surface is provided with a thin silane layer. When the particulate metal oxide which has been pretreated in this way is used, increased strengths and also improved resistance to high atmospheric humidity compared to the untreated metal oxide are found. If, as described, an organic additive is added to the moulding mixture or the particulate metal oxide, it is advantageous to do this before silanization.

The process of the invention is in principle suitable for producing all casting moulds customary for metal casting, i.e., for example, cores and moulds. Particularly when an insulating refractory mould raw material is added or exothermic materials are added to the moulding mixture of the invention, the process of the invention is suitable for producing feeders.

The casting moulds produced from the moulding mixture of the invention or by means of the process of the invention have a high strength immediately after they have been produced, without the strength of the casting moulds after curing being so high that difficulties occur in removal of the casting mould after production of the casting. Furthermore, these casting moulds have a high stability in the presence of a relatively high atmospheric humidity, i.e. the casting moulds can be stored without problems even for a relatively long time. The invention therefore further provides a casting mould which has been obtained by the above-described process of the invention.

The casting mould of the invention is generally suitable for metal casting, in particular light metal casting. Particularly advantageous results are obtained in aluminium casting.

The invention is illustrated below with the aid of examples and with reference to the accompanying figures. In the figures.

EXAMPLE 1

Figure 1:
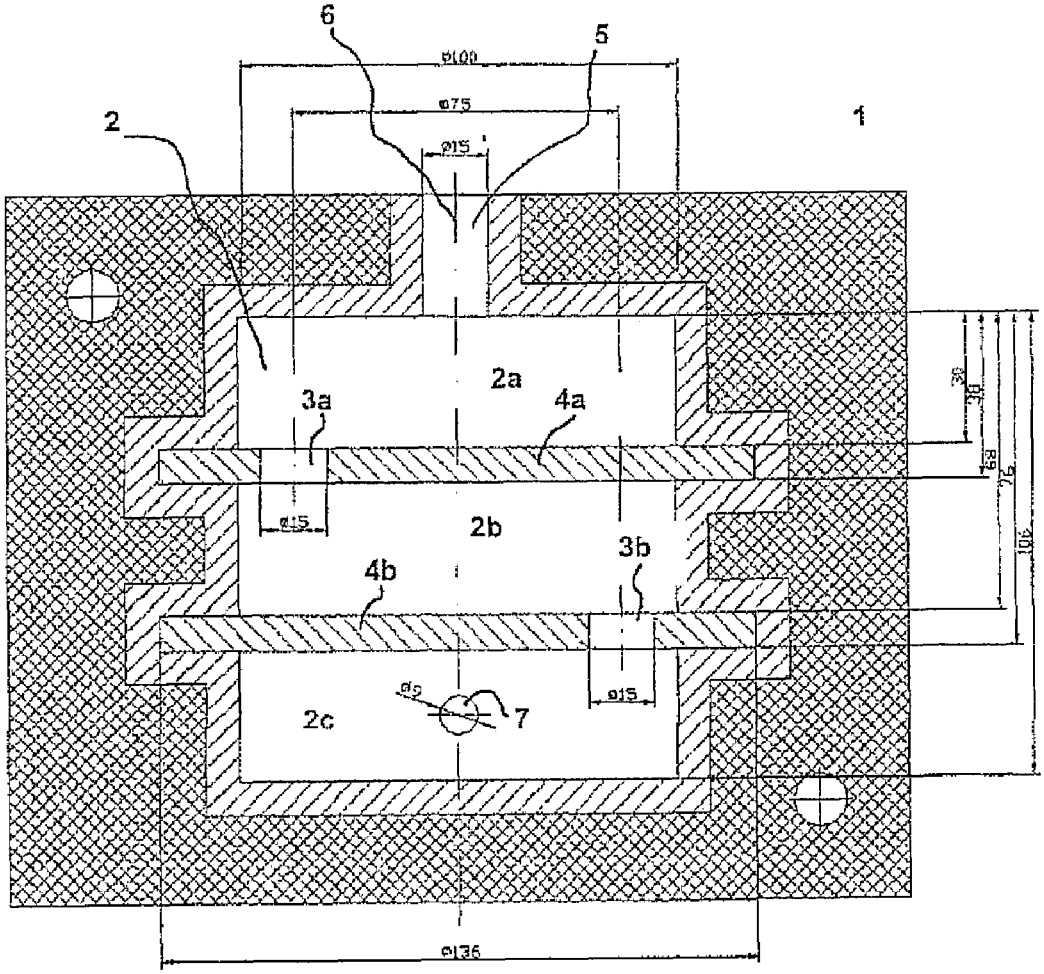
FIG. 1 shows a cross section through a moulding tool used for testing the flowability.

Influence of Synthetic Amorphous Silicon Dioxide on the Strength of Shaped Bodies Using Silica Sand as Mould Raw Material 1. Production and Testing of the Moulding Mixture To test the moulding mixture, Georg-Fischer test bars were produced. Georg-Fischer test bars are cuboidal test bars having the dimensions 150 mm×22.36 mm×20.36 mm.

The composition of the moulding mixture is indicated in Table 1. To produce the Georg-Fischer test bars, the following procedure was employed:

- the components indicated in Table 1 were mixed in a laboratory blade mixer (from Vogel & Schemmann AG, Hagen, Germany). For this purpose, the silica sand was firstly placed in the mixer and the water glass was added while stirring. A sodium water glass having proportions of potassium was used as water glass. The $SiO_2$:$M_2O$ ratio, where M is the sum of sodium and potassium, is therefore indicated in the following tables. After the mixture had been stirred for one minute, the amorphous silicon dioxide if used (examples according to the invention) was added while continuing to stir. The mixture was subsequently stirred for a further one minute;
- the moulding mixtures were transferred to the stock hopper of an H 2.5 hot box core shooting machine from Röperwerk—Gieβereimaschinen GmbH, Viersen, Germany, whose moulding tool had been heated to 200° C.;
- the moulding mixtures were introduced into the moulding tool by means of compressed air (5 bar) and remained in the moulding tool for a further 35 seconds;
- to accelerate curing of the mixtures, hot air (2 bar, 120° C. at the inlet into the tool) was passed through the moulding tool for the last 20 seconds;
- the moulding tool was opened and the test bars were taken out.

To determine the flexural strengths, the test bars were placed in a Georg-Fischer strength testing apparatus equipped with a 3-point bending rig (DISA Industrie AG, Schaffhausen, CH) and the force which led to fracture of the test bars was measured.

The flexural strengths were measured according to the following scheme:

- 10 seconds after removal from the moulding tool (hot strengths);
- about 1 hour after removal from the moulding tool (cold strengths)
- after storage of the cooled cores for 3 hours in a controlled-atmosphere cabinet at 25° C. and 75% relative atmospheric humidity.

The flexural strengths measured are summarized in Table 2.

TABLE 1

Composition of the moulding mixtures

| | Silica sand H 32 | Alkali metal water glass | Amorphous silicon dioxide | |
|---|---|---|---|---|
| 1.1 | 100 pbw | 2.5 pbw[a)] | — | Comparison, not according to the invention |
| 1.2 | 100 pbw | 2.5 pbw[b)] | — | Comparison, not according to the invention |
| 1.3 | 100 pbw | 2.5 pbw[c)] | — | Comparison, not according to the invention |
| 1.4 | 100 pbw | 2.5 pbw[a)] | 0.2 pbw[d)] | According to the invention |
| 1.5 | 100 pbw | 2.5 pbw[a)] | 0.6 pbw[d)] | According to the invention |
| 1.6 | 100 pbw | 2.5 pbw[a)] | 1.0 pbw[d)] | According to the invention |
| 1.7 | 100 pbw | 2.5 pbw[a)] | 1.5 pbw[d)] | According to the invention |
| 1.8 | 100 pbw | 2.5 pbw[b)] | 0.2 pbw[d)] | According to the invention |
| 1.9 | 100 pbw | 2.5 pbw[c)] | 0.2 pbw[d)] | According to the invention |
| 1.10 | 100 pbw | 2.5 pbw[a)] | 0.2 pbw[e)] | According to the invention |
| 1.11 | 100 pbw | 2.5 pbw[a)] | 0.2 pbw[f)] | According to the invention |

[a)]Alkali metal water glass having an $SiO_2$:$M_2O$ ratio of about 2.3
[b)]Alkali metal water glass having an $SiO_2$:$M_2O$ ratio of about 3.35
[c)]Alkali metal water glass having an $SiO_2$:$M_2O$ ratio of about 2.03
[d)]Elkem Microsilica 971 (pyrogenic silica; produced in an electric arc furnace)
[e)]Degussa Sipernat 360 (precipitated silica)
[f)]Wacker HDK N 20 (pyrogenic silica, produced by flame hydrolysis)

TABLE 2

Flexural strengths

| | Hot strengths [N/cm$^2$] | Cold strengths [N/cm$^2$] | After storage in a controlled-atmosphere cabinet [N/cm$^2$] | |
|---|---|---|---|---|
| 1.1 | 80 | 490 | 30 | Comparison, not according to the invention |
| 1.2 | 110 | 220 | 210 | Comparison, not according to the invention |
| 1.3 | 60 | 400 | 110 | Comparison, not according to the invention |
| 1.4 | 105 | 570 | 250 | According to the invention |
| 1.5 | 185 | 670 | 515 | According to the invention |

TABLE 2-continued

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 1.6 | 250 | 735 | 690 | According to the invention |
| 1.7 | 315 | 810 | 700 | According to the invention |
| 1.8 | 140 | 280 | 270 | According to the invention |
| 1.9 | 90 | 510 | 170 | According to the invention |
| 1.10 | 95 | 550 | 280 | According to the invention |
| 1.11 | 110 | 540 | 290 | According to the invention |

2. Result a) Influence of the Amount of Amorphous Silicon Dioxide Added

In Examples 1.4 to 1.7, increasing amounts of amorphous silicon dioxide which had been produced in an electric arc furnace were added to the moulding mixtures. The amount of mould raw material and of water glass was in each case kept constant. In Comparative Example 1.1, a moulding mixture which had the same composition as the moulding mixtures of Examples 1.4 to 1.7 but to which no amorphous silicon dioxide had been added was produced.

The results in Table 2 show that the addition of amorphous silicon dioxide produced in an electric arc significantly increases the flexural strength of the test bars. The flexural strength of the test bars in a measurement after storage at elevated atmospheric humidity in the controlled-atmosphere cabinet is increased to a particularly large extent. This means that the test bars produced using the moulding mixture of the invention essentially retain their strength even after prolonged storage. Increasing amounts of amorphous silicon dioxide added lead to increasing flexural strengths. A large increase in the flexural strengths is initially observed in the case of the flexural strengths measured after storage in the controlled-atmosphere cabinet, although this flattens off with an increasing amount of amorphous silicon dioxide added.

b) Influence of the $SiO_2$:$M_2O$ Ratio of the Alkali Metal Water Glass

In Examples 1.4, 1.8 and 1.9, the same amounts of mould raw material, water glass and amorphous silicon dioxide (produced in an electric arc) were processed in each case, but the $SiO_2$:$M_2O$ ratio of the alkali metal water glass was altered. In Comparative Examples 1.1, 1.2 and 1.3, the same amounts of mould raw material and water glass were processed in each case, but the $SiO_2$:$M_2O$ ratio of the alkali metal water glass was likewise varied. As the flexural strengths reported in Table 2 show, the amorphous silicon dioxide produced in an electric arc furnace is effective regardless of the $SiO_2$:$M_2O$ ratio of the alkali metal water glass.

c) Influence of the Type of Synthetic Amorphous Silicon Dioxide

In Examples 1.4, 1.10 and 1.11, the same amounts of mould raw material, water glass and amorphous silicon dioxide were processed in each case, but the type of synthetic amorphous silicon dioxide was varied. The flexural strengths reported in Table 2 show that precipitated silicas and pyrogenic silicas produced by flame hydrolysis are as effective as amorphous silicon dioxide produced in an electric arc furnace.

EXAMPLE 2

Influence of the Alkali Metal Water Glass:Amorphous Silicon Dioxide Ratio on the Strengths of Shaped Bodies at a Constant Total Amount of Binder Using Silica Sand as Mould Raw Material 1. Production and Testing of the Moulding Mixture The production of the moulding mixtures and their testing was carried out in a manner analogous to Ex. 1. The compositions of the moulding mixtures used for producing the test bars are shown in Table 3. The values found in the flexural strength tests are summarized in Table 4.

TABLE 3

| | Composition of the moulding mixtures | | | |
|---|---|---|---|---|
| | Silica sand H 32 | Alkali metal water glass[b)] | Amorphous silicon dioxide[c)] | |
| 2.1[a)] | 100 pbw | 2.5 pbw | — | Comparison, not according to the invention |
| 2.2 | 100 pbw | 2.3 pbw | 0.2 pbw | According to the invention |
| 2.3 | 100 pbw | 1.9 pbw | 0.6 pbw | According to the invention |
| 2.4 | 100 pbw | 1.5 pbw | 1.0 pbw | According to the invention |

[a)]Corresponds to Experiment 1.1

[b)]Alkali metal water glass having an $SiO_2$:$M_2O$ ratio of about 2.3

[c)]Elkem Microsilica 971

TABLE 4

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 2.1 | 80 | 490 | 30 | Comparison, not according to the invention |
| 2.2 | 90 | 505 | 220 | According to the invention |
| 2.3 | 160 | 505 | 390 | According to the invention |
| 2.4 | 185 | 470 | 380 | According to the invention |

2. Result

Variation of the water glass:amorphous silicon dioxide ratio while maintaining the total amount of water glass and amorphous silicon dioxide enables the hot strengths and the resistance to high atmospheric humidity to be improved, without the cold strengths being increased at the same time.

EXAMPLE 3

Influence of Silanes on the Strengths of the Shaped Bodies

1. Production and Testing of the Moulding Mixtures

The production of the moulding mixtures and their testing was carried out in a manner analogous to Ex. 1. The composition of the moulding mixtures used for producing the test bars are shown in Table 5. The values found in the flexural strength tests are summarized in Table 6.

TABLE 5

| | Composition of the moulding mixtures | | | | |
|---|---|---|---|---|---|
| | Silica sand H 32 | Alkali metal water glass[c)] | Amorphous silicon dioxide[d)] | Silane | |
| 3.1[a)] | 100 pbw | 2.5 pbw | — | — | Comparison, not according to the invention |
| 3.2[b)] | 100 pbw | 2.5 pbw | 0.2 pbw | — | According to the invention |
| 3.3 | 100 pbw | 2.5 pbw | 0.2 pbw | 0.02 pbw[e)] | According to the invention |
| 3.4 | 100 pbw | 2.5 pbw | 0.2 pbw | 0.08 pbw[e)] | According to the invention |
| 3.5 | 100 pbw | 2.5 pbw | 0.2 pbw | 0.02 pbw[f)] | According to the invention |

[a)]Corresponds to Experiment 1.1

[b)]Corresponds to Experiment 1.4

[c)]Alkali metal water glass having an $SiO_2$:$M_2O$ ratio of about 2.3

[d)]Elkem Microsilica 971

[e)]Dynasilan Glymo (Degussa AG), mixed with the amorphous silicon dioxide before the experiment

[f)]Dynasilan Ameo T (Degussa AG), mixed with the amorphous silicon dioxide before the experiment

TABLE 6

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 3.1 | 80 | 490 | 30 | Comparison, not according to the invention |
| 3.2 | 105 | 570 | 250 | According to the invention |
| 3.3 | 120 | 620 | 300 | According to the invention |
| 3.4 | 140 | 670 | 400 | According to the invention |
| 3.5 | 125 | 650 | 380 | According to the invention |

2. Result

Examples 3.3-3.5 show that the addition of silane has a positive effect on the strengths, especially in respect of the resistance to high atmospheric humidity.

EXAMPLE 4

Influence of the Amorphous Silicon Dioxide on the Strengths of Shaped Bodies Using Synthetic Mould Raw Materials 1. Production and Testing of the Moulding Mixture The production of the moulding mixtures and their testing was carried out in a manner analogous to Ex. 1. The compositions of the moulding mixtures used for producing the test bars are shown in Table 7. The values found in the flexural strength tests are summarized in Table 8.

TABLE 7

| | Composition of the moulding mixtures | | | |
|---|---|---|---|---|
| | Mould raw material | Alkali metal water glass[d)] | Amorphous silicon dioxide[e)] | |
| 4.1 | Hollow aluminium silicate microspheres[a)] 100 pbw | 14 pbw | — | Comparison, not according to the invention |
| 4.2 | Hollow aluminium silicate microspheres[a)] 100 pbw | 14 pbw | 1.5 pbw | According to the invention |
| 4.3 | Hollow aluminium silicate microspheres[a)] 100 pbw | 14 pbw | 3.0 pbw | According to the invention |
| 4.4 | Ceramic spheres[b)] 100 pbw | 2.5 pbw | — | Comparison, not according to the invention |
| 4.5 | Ceramic spheres[b)] 100 pbw | 2.5 pbw | 0.2 pbw | According to the invention |
| 4.6 | Glass beads[c)] 100 pbw | 2.5 pbw | — | Comparison, not according to the invention |
| 4.7 | Glass beads[c)] 100 pbw | 2.5 pbw | 0.2 pbw | According to the invention |

[a)]Omegaspheres WSG from Omega Minerals Germany GmbH

[b)]Carbo Accucast LD 50 from Carbo Ceramics Inc.

[c)]Glass beads 100-200 μm from Reidt GmbH & Co. KG

[d)]Alkali metal water glass having an $SiO_2$:$M_2O$ ratio of about 2.3

[e)]Elkem Microsilica 971

TABLE 8

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 4.1 | 120 | 230 | Disintegrate | Comparison, not according to the invention |

TABLE 8-continued

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 4.2 | 160 | 290 | 130 | According to the invention |
| 4.3 | 200 | 340 | 180 | According to the invention |
| 4.4 | 70 | 370 | 20 | Comparison, not according to the invention |
| 4.5 | 100 | 470 | 100 | According to the invention |
| 4.6 | 170 | 650 | 30 | Comparison, not according to the invention |
| 4.7 | 260 | 770 | 100 | According to the invention |

2. Result

It can be seen that the positive effect of the amorphous silicon dioxide is not restricted to silica sand as mould raw material, but the amorphous silicon dioxide also has the effect of increasing the strength in the case of other mould raw materials, e.g. in the case of microspheres, ceramic spheres and glass beads.

EXAMPLE 5

Influence of the Amorphous Silicon Dioxide on the Strengths of Shaped Bodies Having an Exothermic Mix As exothermic mix, the following composition was used:

| | |
|---|---|
| Aluminium (0.063-0.5 mm particle size) | 25% |
| Potassium nitrate | 22% |
| Hollow microspheres (Omegaspheres ® WSG from Omega Minerals Germany GmbH) | 44% |
| Refractory aggregate (chamotte) | 9% |

1. Production and Testing of the Mould Material/Binder Mixtures

The production of the mould material/binder mixtures and their testing were carried out in a manner analogous to Ex. 1. The compositions of the moulding mixtures used for producing the test bars are shown in Table 9. The values found in the flexural strength tests are summarized in Table 10.

TABLE 9

| | Exothermic mix | Alkali metal water glass[a)] | Amorphous silicon dioxide[b)] | |
|---|---|---|---|---|
| 5.1 | 100 pbw | 14 pbw | — | Comparison, not according to the invention |
| 5.2 | 100 pbw | 14 pbw | 1.5 pbw | According to the invention |

TABLE 9-continued

| | Exothermic mix | Alkali metal water glass[a)] | Amorphous silicon dioxide[b)] | |
|---|---|---|---|---|
| 5.3 | 100 pbw | 14 pbw | 3.0 pbw | According to the invention |

[a)]Alkali metal water glass having an $SiO_2$:$M_2O$ ratio of about 2.3
[b)]Elkem Microsilica 971

TABLE 10

| | Flexural strengths | | | |
|---|---|---|---|---|
| | Hot strengths [N/cm$^2$] | Cold strengths [N/cm$^2$] | After storage in a controlled-atmosphere cabinet [N/cm$^2$] | |
| 5.1 | 50 | 180 | Disintegrate | Comparison, not according to the invention |
| 5.2 | 70 | 225 | 70 | According to the invention |
| 5.3 | 95 | 280 | 110 | According to the invention |

2. Result

Even when exothermic mixes are used as mould raw material, the amorphous silicon dioxide produces an increase in strength.

EXAMPLE 6

Improvement of the Flowability of the Moulding Mixture

1. Production and Testing of the Moulding Mixture

The components indicated in Table 11 were mixed in a laboratory blade mixer (from Vogel & Schemmann AG, Hagen, Germany). For this purpose, the silica sand was firstly placed in the mixing vessel and the water glass was added while stirring. After the mixture had been stirred for one minute, the amorphous silicon dioxide was added while continuing to stir. The mixture was subsequently stirred for a further one minute. Graphite was then added in the case of Examples 6.2 to 6.4 and the mixture was finally stirred for a further one minute.

The flowability of the moulding mixtures was determined by means of the extent to which the moulding tool 1 shown in FIG. 1 was filled. The moulding tool 1 comprises two halves which can be joined to one another so that a hollow space 2 is formed. The hollow space 2 comprises three chambers 2*a*, 2*b* and 2*c* which have a circular cross section and have a diameter of 100 mm and a height of 30 mm. The chambers 2*a*, 2*b* and 2*c* are connected by circular openings 3*a*, 3*b* which have a diameter of 15 mm. The circular openings are present in dividing walls 4*a*, 4*b* which have a thickness of 8 mm. The openings 3*a*, 3*b* are each offset by 37.5 mm from the central axis 6 at a maximum distance from one another. An inlet 5 leads into the chamber 2*a* along the central axis 6 so as to allow the moulding mixture to be introduced. The inlet 5 has a circular cross section having a diameter of 15 mm. The chamber 2*c* is provided with a vent 7 which has a circular cross section having a diameter of 9 mm and is provided with a slit nozzle. The moulding tool 1 is placed in a core shooting machine for filling.

In detail, the following procedure was employed:

mixing of the components indicated in Table 11;

transfer of the mixtures into the stock hopper of an H 1 cold box core shooting machine from Röperwerke—Gießereimaschinen GmbH, Viersen, Germany;

introduction of the mixtures into the unheated moulding tool 1 by means of compressed air (5 bar);

curing of the mixtures by introduction of $CO_2$;

removal of the cured shaped bodies from the tool and recording of their weight.

The measured weights of the shaped bodies are summarized in Table 12.

TABLE 11

Composition of the moulding mixtures

| | Silica sand H 32 | Alkali metal water glass[a)] | Amorphous silicon dioxide[b)] | Graphite | |
|---|---|---|---|---|---|
| 6.1 | 100 pbw | 2.5 pbw | 0.2 pbw | — | Comparison, not according to the invention |
| 6.2 | 100 pbw | 2.5 pbw | 0.2 pbw | 0.2 pbw | According to the invention |
| 6.3 | 100 pbw | 2.5 pbw | 0.2 pbw | 0.2 pbw | According to the invention |
| 6.4 | 100 pbw | 2.5 pbw | 0.2 pbw | 1.0 pbw | According to the invention |

[a)]Alkali metal water glass having an $SiO_2$:$M_2O$ ratio of about 2.3

[b)]Elkem Microsilica 971

TABLE 12

Weight of the shaped bodies

| | Weight [g] | |
|---|---|---|
| 6.1 | 512 | Comparison, not according to the invention |
| 6.2 | 534 | According to the invention |
| 6.3 | 564 | According to the invention |
| 6.4 | 588 | According to the invention |

2. Result

The addition of graphite results in an improvement in the flowability of the moulding mixtures, i.e. the tool is filled better.

EXAMPLE 7

Casting Tests

1. Production and Testing of the Moulding Mixture

Figure 2:
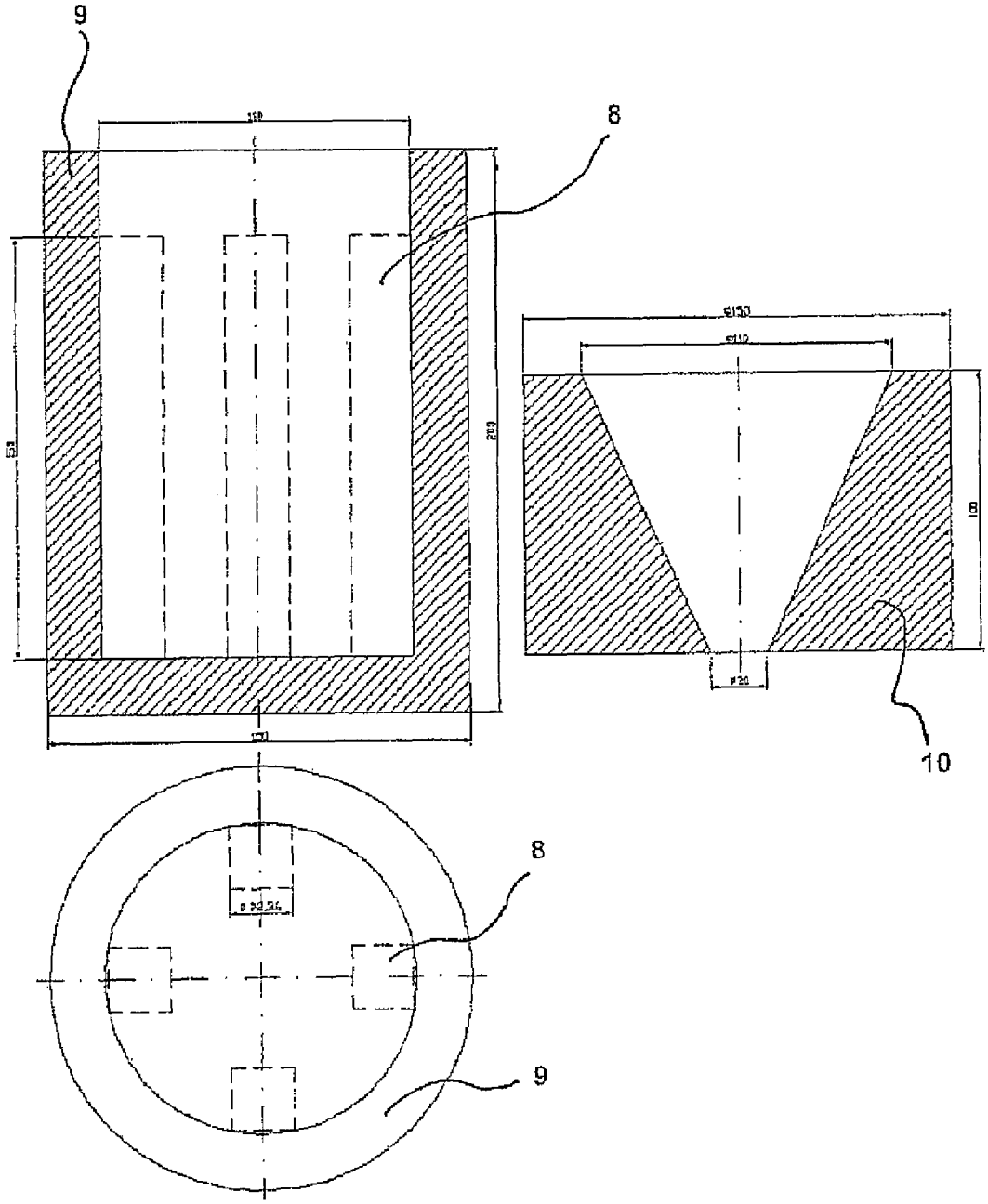
FIG. 2 shows a cross section through a casting mould which has been used for testing the moulding mixture of the invention.

To carry out the casting tests, four of the Georg-Fischer test bars 8 produced in Examples 1 to 6 were in each case adhesively bonded with an angle of 90° between each of them into the lower part 9 of the test mould shown in FIG. 2. The funnel-shaped upper part 10 of the test mould was subsequently adhesively bonded onto the lower part 9. Lower part 9 and upper part 10 of the test mould were produced by a conventional polyurethane cold box process. The test mould was then filled with liquid aluminium (740° C.). After cooling of the metal, the outer test mould was removed and the test castings were assessed in respect of their surface quality (sand adhesions, smoothness) in the sections corresponding to the four test specimens. The grades 1 (very good) to 10 (very poor) were awarded in the assessment. The results are summarized in Table 13.

TABLE 13

Composition of the moulding mixtures and casting result

| | Composition, see Ex. | Surface quality | |
|---|---|---|---|
| 7.1 | 1.1 (Tab. 1) | 5 | Comparison, not according to the invention |
| 7.2 | 1.4 (Tab. 1) | 5 | According to the invention |
| 7.3 | 4.1 (Tab. 7) | 2 | According to the invention |
| 7.4 | 4.2 (Tab. 7) | 2 | According to the invention |
| 7.5 | 4.4 (Tab. 7) | 4 | According to the invention |
| 7.6 | 4.5 (Tab. 7) | 4 | According to the invention |
| 7.7 | 4.6 (Tab. 7) | 1 | According to the invention |
| 7.8 | 4.7 (Tab. 7) | 1 | According to the invention |

2. Result

The results from Table 11 show that the use of synthetic mould raw materials such as hollow aluminium silicate microspheres, ceramic spheres or glass beads sometimes considerably improves the surface quality of the castings.

EXAMPLE 8

Effect of Organic Additives on the Casting Result

1. Production and Testing of the Moulding Mixtures

The compositions of the moulding mixtures examined are listed in Table 14.

The casting tests and their evaluation was carried out in a manner analogous to Ex. 7. The result of the casting tests may likewise be found in Table 14.

TABLE 14

Composition of the moulding mixtures and casting result

| | Silica sand H 32 | Alkali metal water glass[b)] | Amorphous silicon dioxide[c)] | Organic additive | Casting result |
|---|---|---|---|---|---|
| 8.1[a)] | 100 pbw | 2.5 pbw | 0.2 pbw | — | 5 |
| 8.2 | 100 pbw | 2.5 pbw | 0.2 pbw | 0.2 pbw[d)] | 3 |
| 8.3 | 100 pbw | 2.5 pbw | 0.2 pbw | 0.2 pbw[e)] | 1 |
| 8.4 | 100 pbw | 2.5 pbw | 0.2 pbw | 0.2 pbw[f)] | 3 |
| 8.5 | 100 pbw | 2.5 pbw | 0.2 pbw | 0.2 pbw[g)] | 2 |
| 8.6 | 100 pbw | 2.5 pbw | 0.2 pbw | 1.0 pbw[h)] | 2 |
| 8.7 | 100 pbw | 2.5 pbw | 0.2 pbw | 1.0 pbw[i)] | 2 |
| 8.8 | 100 pbw | 2.5 pbw | 0.2 pbw | 0.2 pbw[j)] | 1 |
| 8.9 | 100 pbw | 2.5 pbw | 0.2 pbw | 0.2 pbw[k)] | 3 |
| 8.10 | 100 pbw | 2.5 pbw | 0.2 pbw | 0.2 pbw[l)] | 1 |
| 8.11 | 100 pbw | 2.5 pbw | 0.2 pbw | 0.2 pbw[m)] | 1 |

[a)]Corresponds to Experiment 1.4

[b)]Alkali metal water glass having an $SiO_2$:$M_2O$ ratio of about 2.3

[c)]Elkem Microsilica 971

[d)]Novolak Bakelite 0235 DP (Bakelite AG)

[e)]Polyethylene glycol PEG 6000 (BASF AG)

[f)]Polyol PX (Perstorp AB)

[g)]PE fibres Stewathix 500 (Schwarzwälder Textilwerke GmbH)

[h)]Vinylacetate-ethylene copolymer Vinnex C 50 (Wacker Chemie GmbH)

[i)]Polyamid 12 Vestosint 1111 (Degussa AG)

[j)]Balsam resin WW (Bassermann & Co)

[k)]Zinc gluconate (Merck KGaA)

[l)]Zinc oleate (Peter Greven Fettchemie GmbH & Co. KG)

[m)]Aluminium stearate (Peter Greven Fettchemie GmbH & Co. KG)

2. Result

Table 12 shows that the addition of organic additives improves the surface of the castings.

The invention claimed is:

1. Moulding mixture for producing casting moulds for metalworking, comprising at least:

a refractory mould raw material; and a binder comprising water glass, the weight thereof being calculated based on a solids content of 30 to 60% by weight of an aqueous water glass composition, and a particulate synthetic amorphous silicon dioxide, wherein the binder is cured at 100° C. to 300° C.; and wherein the binder is present in the moulding mixture in an amount of less than 5% by weight, or, if hollow microspheres are present in the mould raw material, the binder is present in an amount less than 20%, by weight.

2. Moulding mixture according to claim 1, characterized in that the synthetic amorphous silicon dioxide is selected from the group consisting of precipitated silica and pyrogenic silica and mixtures thereof.

3. Moulding mixture according to claim 1, characterized in that the water glass has an $SiO_2/M_2O$ ratio in the range from 1.6 to 4.0 where M represents sodium ions and/or potassium ions.

4. Moulding mixture according to claim 1, characterized in that the water glass has a solids content of $SiO_2$ and $M_2O$ in the range from 30 to 60% by weight.

5. Moulding mixture according to claim 1, characterized in that the particulate synthetic amorphous silicon dioxide comprises from 2 to 60% by weight, based on the binder.

6. Moulding mixture according to claim 1, characterized in that the mould raw material comprises at least a proportion of hollow microspheres.

7. Moulding mixture according to claim 6, characterized in that the hollow microspheres comprise hollow aluminum silicate microspheres and/or hollow glass microspheres.

8. Moulding mixture according to claim 1, characterized in that the mould raw material comprises at least a proportion of glass granules, glass beads and/or spherical ceramic bodies and mixtures thereof.

9. Moulding mixture according to claim 1, characterized in that the mould raw material comprises at least a proportion of mullite, chromium ore sand and/or olivine and mixtures thereof.

10. Moulding mixture according to claim 1, further comprising an oxidizable metal and an oxidant.

11. Moulding mixture according to claim 1, further comprising a platelet-like lubricant.

12. Moulding mixture according to claim 11, characterized in that the platelet-like lubricant is selected from the group consisting of graphite and molybdenum sulphide and mixtures thereof.

13. Moulding mixture according to claim 1, further comprising at least one organic additive which is solid at room temperature.

14. Moulding mixture according to claim 1, further comprising at least one silane.

15. Process for producing casting moulds for metalworking, which comprises the steps:

producing a moulding mixture according to claim 1;

moulding the moulding mixture; and curing the moulding mixture by heating the moulding mixture to temperature in the range from 100° C. to 300° C. to produce the cured casting mould.

16. Process according to claim 15, characterized in that heated air is blown into the moulding mixture for curing.

17. Process according to claim 15, characterized in that the heating of the moulding mixture is effected by the action of microwaves.

18. Process according to claim 15, characterized in that the casting mould is a feeder.

19. Casting mould obtained by a process according to claim 15, wherein the casting mould has high strength immediately after production and high stability in the presence of relatively high humidity.

20. A process for the casting of a metal product comprising preparing a casting mould using the process of claim 15, and introducing liquid metal into the casting mould to produce the cast metal product.

21. Process according to claim 15, characterized in that the curing is carried out for less than 5 min.

22. Process according to claim 15, characterized in that heated air is blown into the mould during the curing process.

23. Process for producing casting moulds for metalworking, which comprises the steps:

producing a moulding mixture comprising at least:

a refractory mould raw material, and a binder comprising water glass, the weight being calculated based on a solid content of 30 to 60% by weight of an aqueous water glass composition, and a particulate synthetic amorphous silicon dioxide, wherein the binder is present in the moulding mixture in an amount of less than 5% by weight, or, if the moulding mixture comprises hollow microspheres, said binder is present in the moulding mixture in an amount of less than 20% by weight;

moulding the moulding mixture;

and curing the moulding mixture for less than 5 min by heating the moulding mixture to a temperature in the range from 100 to 300° C. to produce the cured casting mould, wherein during curing, heated air is blown into the mould.

* * * * *